United States Patent [19]

Hunter et al.

[11] Patent Number: 4,661,179

[45] Date of Patent: Apr. 28, 1987

[54] DESTRUCTION OF WASTE EXPLOSIVE BY HYDROGENOLYSIS

[75] Inventors: Benjamin A. Hunter, Kingsport, Tenn.; Everett E. Gilbert, Morristown, N.J.

[73] Assignee: The United States of America as represented by the Secretary of the Army, Washington, D.C.

[21] Appl. No.: 891,802

[22] Filed: Jul. 24, 1986

[51] Int. Cl.[4] ..... D03D 23/00

[52] U.S. Cl. ..... 149/124; 149/109.6; 110/237; 110/341; 110/342; 110/344

[58] Field of Search ..... 149/109.6, 124; 110/237, 341, 342, 344

[56] References Cited

U.S. PATENT DOCUMENTS 4,231,822 11/1980 Roth ..... 149/109.6

4,574,714 3/1986 Bach et al. ..... 110/346

4,602,574 7/1986 Bach et al. ..... 110/346

*Primary Examiner*—Stephen J. Lechert, Jr.

*Attorney, Agent, or Firm*—Anthony T. Lane; Harold H. Card, Jr.; Edward F. Costigan

[57] ABSTRACT

A method for destroying organic explosives, such as RDX and HMX, by hydrogenolysis comprises contacting liquors containing waste explosive, produced in the manufacture and processing of the explosives, with hydrogen in the presence of a heterogeneous hydrogenation catalyst, such as nickel-on-kieselguhr, for a sufficient period to destroy the explosives. The method is simple and economic and destroys the explosives, which are considered to be toxic, hazardous and non-biodegradable in soil and hence are not amenable to landfill or discharge into rivers etc., thereby eliminating or reducing the attendant pollution problems to acceptable levels.

10 Claims, No Drawings

DESTRUCTION OF WASTE EXPLOSIVE BY HYDROGENOLYSIS

GOVERNMENTAL INTEREST

The invention described herein may be manufactured, used and licensed by or for the Government for Governmental purposes without payment to us of any royalties thereon.

BACKGROUND OF THE INVENTION

In the manufacture of organic explosives such as RDX, HMX, TNT, nitroglycerin, nitroguanidine, nitrocellulose and Composition B, liquors are produced, which contain significant to trace amounts of residual/-waste explosives often together with other toxic materials. These liquors are treated to destroy the waste explosives contained therein, which are considered to be toxic, hazardous and non-biodegradable in soil and thus constitute a source of pollution. Known methods for destroying these waste explosives include treating the explosives, for example, with sodium hydroxide or reductants such as sodium sulfide and oxalic acid (U.S. Pat. No. 4,231,822). Such methods are not entirely satisfactory, since they are costly or inefficient and may not eliminate or reduce pollution problems sufficiently.

SUMMARY OF THE INVENTION

The present invention provides a process for the destruction of waste explosives contained in liquors produced in the manufacture and processing of explosives containing a nitro, nitrate or nitramine group in the molecule. The process comprises subjecting the waste explosive dissolved or suspended in such liquor to catalytic hydrogenation/hydrogenolysis with hydrogen in the presence of a heterogeneous hydrogenation catalyst for a sufficient period to destroy the waste explosive. The novel process is simple, economic and effective and eliminates the pollution problems associated with such waste explosives by producing a material which is acceptable for disposal, for example, in a landfill or incineration.

DETAILED DESCRIPTION OF THE INVENTION

The novel process can be effected in a batch operation by charging a mixture of the solid catalyst and the liquor containing the dissolved or suspended explosive to be destroyed into a vessel and introducing gaseous hydrogen into the vessel, preferably under superatmospheric pressure, to effect the hydrogenation. The reaction can also be effected in a continuous operation, wherein the explosives liquor, filtered if necessary to remove solid components, is pumped, preferably concurrently, with hydrogen through a fixed bed of the hydrogenation catalyst in a single pass or multiple passes at a rate providing a sufficient contact time to destroy the explosive.

The hydrogenation/hydrogenolysis process of the present invention can be carried out by employing a wide variety of hydrogenation catalysts, including palladium, platinum, nickel and Raney nickel, which may be unsupported or supported on a suitable substrate such as carbon, alumina or kieselguhr. The amount of catalyst employed can be suitably determined and varies, for example, with the particular catalyst employed and the results and efficiency desired.

The process of this invention can be performed under ordinary or elevated pressure. As long as hydrogen gas is supplied for the reaction, the hydrogen pressure does not appear to have a lower limit, since in a sealed vessel the reaction will continue until the hydrogen pressure is less than atmospheric. The reaction rate is speeded when it is carried out under superatmospheric pressures, conveniently from about 50 to 200 psig, although higher hydrogen pressures can be employed if desired. Similarly, the reaction is accelerated by effecting the process at elevated temperatures, conveniently from about 50° C. to about 120° C.

The present invention is specifically illustrated in the following examples, which show the destruction of the high explosives RDX (cyclotrimethylenetrinitramine), HMX (cyclotetramethylenetetranitramine) and related explosives TAX (1-acetyl-3,5-dinitrocyclotrimethylenetriamine) and SEX (1-acetyl-3,5,7-trinitrocyclotetramethylenetetramine, including by-products of RDX and HMX manufacture, particularly dimethylnitrosamine (DMN). DMN is toxic and a potent carcinogen, and constitutes a serious pollution problem even at very low concentrations.

As is well known, RDX and HMX are usually manufactured by nitrolysis of hexamethylenetetramine with a mixture of nitric acid and ammonium nitrate in an acetic acid-acetic anhydride solution. When the reaction is complete the reaction mixture is "simmered", after which the solid explosives are separated from the "spent acid" by filtration.

The explosives fraction is then slurried in water and the slurry is pumped to a recrystallization still, where the explosives are extracted and recrystallized, and then pumped to a vacuum filter to separate the solid explosives from the aqueous phase, commonly referred to as the "dewater" water. This dewater, which contains small amounts of dissolved and suspended explosives, is a source of pollution.

The "spent acid" fraction is distilled to recover the acetic acid as distillate. The bottoms, commonly referred to as "final sludge", is an aqueous slurry of ammonium nitrate, ammonium formate, traces of acetic acid and explosives together with various organic impurities. The trace of explosives (ca. 0.3%) and the toxic nature of some of the organic impurities, notably dimethylnitrosamine (DMN), renders this sludge unsuitable for most uses or disposal.

At present the final sludge is treated with sodium hydroxide to destroy the explosives and convert ammonium nitrate to sodium nitrate and generate ammonia, which is recovered by distillation. However, such treatment is cost inefficient, since the value of the recovered sodium nitrate (fertilizer) and ammonia does not cover the operational cost. Furthermore, the ammonia recovery process also provides a source of pollution. The "dewater" phases from both RDX and HMX manufactures are passed through a settling basin prior to discharge to remove solid explosives, which are recovered, while all dissolved explosives and some suspended explosives pass through the settling basin and constitute a pollution source. As described in the following examples, toxic nitramines and nitrosamines contained in aqueous liquors produced in the manufacture and processing of RDX and HMX are readily destroyed and converted into harmless materials by catalytic hydrogenation.

EXAMPLE 1

Catalytic Hydrogenation of RDX Dewater 400 ml. of HMX dewater, analysis:
RDX—15 ug/ml
HMX—4 ug/ml
TAX—5 ug/ml
SEX—6 ug/ml
and 10.0 g of 60% nickel-on-kieselguhr catalyst (Harshaw catalyst Ni 0104P marketed by the Harshaw Corp.) were charged to a steel autoclave and heated to 50° C. The autoclave was then pressurized with hydrogen and the hydrogenation was carried out under 175 psig hydrogen pressure at 50° C. for one hour with agitation. Analysis of the resultant mixture by high pressure liquid chromatography (HPLC) showed that RDX, HMX, TAX and SEX were absent and had been completely destroyed.

EXAMPLE 2.

Catalytic Hydrogenation of RDX Dewater analysis:
RDX—100 ug/ml
HMX—4 ug/ml
TAX—8 ug/ml
and 10.0 g of Harshaw catalyst Ni 0104P were charged to an autoclave and hydrogenated as described in Example 1. HPLC analysis revealed that RDX, HMX, TAX, DMN and other components had been completely destroyed.

The above example was repeated except that the RDX dewater, which did not contain DMN (<0.1 ug/mL) was spiked with DMN (4 ug/mL). HPLC analysis of the resulting product showed that RDX, HMX, TAX and DMN components had been completely eliminated.

EXAMPLE 3

Catalytic Hydrogenation of Final Sludge 400 ml. of final sludge (analysis in ug/mL: RDX 728; HMX 217; DMN 0.16 were hydrogenated under 50 psig hydrogen pressure at 100° C. for one hour with agitation in the presence of 10.0 g of 5% palladium-on-carbon catalyst marketed by Engelhard Industries. HPLC analysis showed that RDX, HMX, TAX, SEX and DMN and other components had been completely destroyed.

The invention is particulary valuable for destroying explosives containing nitramine groups (—$NHNO_2$), as well as nitrosamines and other compounds, which are formed in the manufacture of such nitramine explosives and consitute a serious pollution problem even at extremely low concentrations, as noted above. Also, the process of the present invention can be effectively employed in similar manner for the destruction of waste explosives containing a nitro group (—$NO_2$), such as TNT (2,4,6-trinitrotoluene), composition B (a mixture of TNT and RDX), as well as explosives containing a nitrate group (—$ONO_2$), such as nitroglycerine or nitrocellulose, in liquors produced in the manufacture and processing (including purification) of such explosives.

What is claimed is:

1. A process for the destruction of waste explosives contained in a liquor produced in the manufacture and processing of an organic explosive containing a nitro, nitrate or nitramino group in the molecule, which comprises contacting the explosive in said liquor with hydrogen in the presence of a heterogeneous hydrogenation catalyst for a sufficient period to effect destruction of said explosive.

2. The process of claim 1, wherein the explosive contains a nitramine group.

3. The process of claim 2, wherein the explosive is at least one of cyclotrimethylenetrinitramine (RDX) and cyclotetramethylenetetranitramine (HMX).

4. The process of claim 3, wherein the liquor is RDX or HMX dewater or final sludge.

5. The process of claim 1, 2, 3 or 4, wherein the catalyst is selected from the group consisting of platinum, palladium, nickel or Raney nickel.

6. The process of claim 1, 2, 3 or 4, wherein the process is carried out under superatmospheric hydrogen pressure.

7. The process of claim 1, 2, 3 or 4, wherein the hydrogen pressure is about from about 50 psig to about 200 psig and the temperature is from about 50° C. to about 120° C.

8. The process of claim 4, wherein the catalyst is selected from the group consisting of palladium, platinum, nickel or Raney nickel, the hydrogen pressure is from about 50 psig to about 200 psig and the temperature is about from 50° C. to 120° C.

9. The process of claim 2, wherein the liquor contains a nitrosamine compound.

10. The process of claim 8, wherein the nitrosamine compound is dimethylnitrosamine.

* * * * *